US010087934B2

(12) United States Patent
Nagano et al.

(10) Patent No.: US 10,087,934 B2
(45) Date of Patent: Oct. 2, 2018

(54) VANE COMPRESSOR

(71) Applicant: KABUSHIKI KAISHA TOYOTA JIDOSHOKKI, Kariya, Aichi-ken (JP)

(72) Inventors: Hiroki Nagano, Aichi-ken (JP); Tatsushi Mori, Aichi-ken (JP); Kunihisa Matsuda, Aichi-ken (JP); Yuya Hattori, Aichi-ken (JP)

(73) Assignee: KABUSHIKI KAISHA TOYOTA JIDOSHOKKI, Kariya-shi, Aichi-ken (JP)

( * ) Notice: Subject to any disclaimer, the term of this patent is extended or adjusted under 35 U.S.C. 154(b) by 95 days.

(21) Appl. No.: 15/217,413

(22) Filed: Jul. 22, 2016

(65) Prior Publication Data

US 2017/0030353 A1 Feb. 2, 2017

(30) Foreign Application Priority Data

Jul. 27, 2015 (JP) ..... 2015-147386
Jul. 21, 2016 (JP) ..... 2016-143713

(51) Int. Cl.
*F01C 21/04* (2006.01)
*F04C 2/324* (2006.01)
(Continued)

(52) U.S. Cl.
CPC ..... *F04C 18/3441* (2013.01); *B60H 1/3223* (2013.01); *F01C 21/0854* (2013.01);
(Continued)

(58) Field of Classification Search
USPC ..... 418/83, 92, 180, 263, 267–269, 133, 93, 418/110, 131
See application file for complete search history.

(56) References Cited

U.S. PATENT DOCUMENTS 2,800,083 A * 7/1957 Tweedale ..... F04C 14/26 137/115.03
3,081,022 A * 3/1963 Michie ..... F04C 18/332 418/133
(Continued)

FOREIGN PATENT DOCUMENTS

JP 63-201388 A 8/1988
JP 02-185692 A 7/1990
(Continued)

OTHER PUBLICATIONS

Communication dated Feb. 6, 2018, issued by the Korean Intellectual Property Office in corresponding Korean Application No. 10-2016-0093982.

*Primary Examiner* — Mark Laurenzi
*Assistant Examiner* — Deming Wan
(74) *Attorney, Agent, or Firm* — Sughrue Mion, PLLC

(57) ABSTRACT

A vane compressor includes a housing having therein a suction chamber, a discharge chamber having a cover, and a rotor chamber, a rotor having therein a plurality of vane slots, and a plurality of vanes. The housing includes a partition that has a first surface forming the other surface of the rotor chamber and a second surface and separates the rotor chamber from the discharge chamber. An intermediate pressure chamber having a pressure that is lower than the discharge chamber and higher than the suction chamber is formed between the partition and the cover. A part of the second surface and a part of a covering surface of the discharge chamber cover are spaced away from each other by the intermediate pressure chamber. The intermediate pressure chamber is disposed so as to overlap at least a part of the other surface of the rotor chamber.

4 Claims, 7 Drawing Sheets

(51) Int. Cl.

| | |
|---|---|
| ***F04C 29/02*** | (2006.01) |
| ***F01C 1/324*** | (2006.01) |
| ***F04C 18/324*** | (2006.01) |
| ***F04C 18/344*** | (2006.01) |
| ***B60H 1/32*** | (2006.01) |
| ***F01C 21/08*** | (2006.01) |
| ***F01C 21/10*** | (2006.01) |
| ***F04C 29/00*** | (2006.01) |
| ***F04C 29/12*** | (2006.01) |

(52) U.S. Cl.

CPC ..... *F01C 21/108* (2013.01); *F04C 18/3448* (2013.01); *F04C 29/0021* (2013.01); *F04C 29/026* (2013.01); *F04C 29/12* (2013.01); *F04C 2210/26* (2013.01); *F04C 2240/20* (2013.01); *F04C 2240/30* (2013.01)

(56) References Cited

U.S. PATENT DOCUMENTS

| | | | | |
|---|---|---|---|---|
| 4,936,761 | A * | 6/1990 | Hasegaki ..... | F01C 21/0872 418/268 |
| 6,929,457 | B2 * | 8/2005 | Matsuura ..... | F01C 21/0872 418/268 |

FOREIGN PATENT DOCUMENTS

| | | | |
|---|---|---|---|
| JP | 04-159484 | A | 6/1992 |
| JP | 2012-127335 | A | 7/2012 |
| KR | 93-2464 | B1 | 4/1993 |

* cited by examiner

VANE COMPRESSOR

BACKGROUND OF THE INVENTION

The present invention relates to a vane compressor.

Japanese Unexamined Patent Application Publication No. H02-185692 discloses a vane compressor including a housing having a rear side plate as a partition that separates a rotor chamber from a discharge chamber. The rear side plate has on the side thereof facing the rotor chamber a first surface and on the opposite side thereof a second surface. The rear side plate has therethrough a shaft hole through which a rotary shaft is rotatably inserted. The rear side plate further has an oil passage that provides communication between the discharge chamber and the shaft hole. A cover is fixed to the rear side plate so as to face the second surface in the discharge chamber.

According to the vane compressor of the Publication, with the rotation of the rotor in the rotor chamber, refrigerant gas in the suction chamber is taken into the compression chamber and compressed. At this time, part of the lubricant oil contained in the refrigerant gas in the discharge chamber is supplied to the shaft hole through the oil passage.

A vane compressor is required to be as small as possible for improving the mountability thereof on a vehicle or the like. In the above vane compressor, it may be contemplated to reduce the dimension of the partition such as the rear side plate in the axial direction.

In this case, however, the partition tends to be bent toward the compression chamber by the pressure difference between the high-pressure discharge chamber and the compression chamber. Therefore, the thrust clearance that is provided in the axial direction between the first surface of the partition and the rotor may be reduced during the operation of the vane compressor, with the result that the resistance during the rotation of the rotor under a high load increases and a significant power loss is caused. Such problem may be significant especially when an oil passage is formed in the partition. On the other hand, if the thrust clearance is formed relatively larger, refrigerant gas in the compression chamber tends to leak out easily under a low load. Therefore, there is a fear of a drop in the volumetric efficiency of the vane compressor.

The present invention which has been made in view of the circumstances above is directed to providing a vane compressor that is small in the axial dimension and suppresses a drop in the volumetric efficiency.

SUMMARY OF THE INVENTION

In accordance with an aspect of the present invention, there is provided a vane compressor that includes a housing having therein a suction chamber, a discharge chamber, a rotor chamber, a rotor that is disposed in the rotor chamber so as to be rotatable about an axis of rotation and has therein a plurality of vane slots, and a plurality of vanes that is provided in the respective vane slots so as to be slidable in and out of the vane slots. A plurality of compression chambers is formed by one surface of the rotor chamber, an inner peripheral surface of the rotor chamber, the other surface of the rotor chamber, an outer peripheral surface of the rotor chamber, and the vanes. The housing includes a partition that separates the rotor chamber from the discharge chamber. The partition has a first surface forming the other surface of the rotor chamber and a second surface that is located opposite to the first surface in a direction of the axis of rotation. The discharge chamber has therein a cover that is fixed to the partition and has a covering surface facing the second surface. An intermediate pressure chamber having a pressure that is lower than a pressure in the discharge chamber and higher than a pressure in the suction chamber is formed between the partition and the cover. The intermediate pressure chamber spaces a part of the second surface and a part of the covering surface away from each other in the direction of the axis of rotation. The intermediate pressure chamber is disposed so as to overlap at least a part of the other surface of the rotor chamber as viewed in the direction of the axis of rotation. An oil passage is formed in the cover and provides communication between the discharge chamber and the intermediate pressure chamber.

Other aspects and advantages of the invention will become apparent from the following description, taken in conjunction with the accompanying drawings, illustrating by way of example the principles of the invention.

DETAILED DESCRIPTION OF THE EMBODIMENTS

The following will describe first and second embodiments of the present invention with references to the accompanying drawings.

First Embodiment

Figure 1:
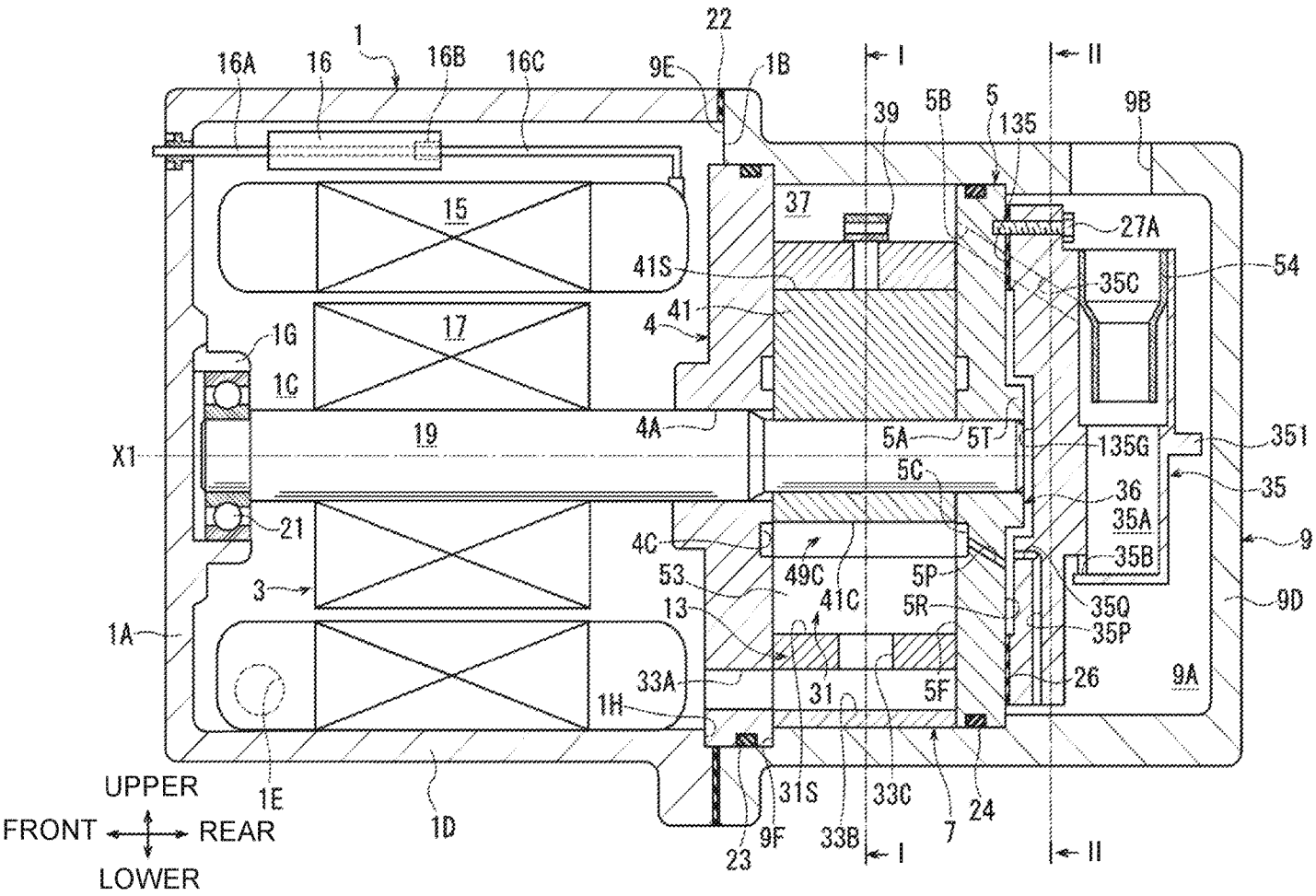
FIG. 1 is a longitudinal cross-sectional view showing a vane compressor according to a first embodiment of the present invention.

FIG. 1 shows a motor-driven vane compressor according to a first embodiment of the present invention (hereinafter, referred to as the compressor). The compressor includes a motor housing 1, a motor mechanism 3, a first side plate 4, a second side plate 5, a cylinder block 7, a main housing 9, and a compression mechanism 13. The motor housing 1, the first and second side plates 4, 5, the cylinder block 7, and the main housing 9 are one example of the housing of the present invention. Furthermore, the second side plate 5 is an example of the partition of the present invention.

In the following description, the left side of FIG. 1 where the motor housing 1 is illustrated will be referred to as the front side of the compressor, and the right side of FIG. 1 where the main housing 9 is illustrated will be referred to as the rear side of the compressor. Furthermore, the upper side of FIG. 1 will be referred to as the upper side of the compressor and the lower side of FIG. 1 will be referred to as the lower side of the compressor. The directions indicated by double-headed arrows in FIG. 1 also apply to FIGS. 2 to 8. It is to be noted that the front, rear, upper and lower directions in the first embodiment is one example. The mounting posture of the compressor according to the present invention may be changed appropriately in accordance with the vehicle or the like on which the compressor is installed.

Referring to FIG. 1, the motor housing 1 is of a bottomed cylindrical shape having at the front end thereof a bottom wall 1A and at the rear end thereof an open end 1B, and a cylindrical portion 1D extending in the axial direction between the bottom wall 1A and the open end 1B. The cylindrical portion 1D is connected at a front peripheral edge thereof with an outer circumferential edge of the bottom wall 1A. The motor housing 1 has therein a motor chamber 1C that also serves as a suction chamber. The cylindrical portion 1D has a substantially cylindrical shape about an axis of rotation X1 of a rotary shaft 19. An intake port 1E is formed through the cylindrical portion 1D of the motor housing 1, providing communication between the motor chamber 1C and the outside of the compressor. An evaporator (not shown) for a vehicle air conditioner is connected to the intake port 1E through a pipe (not shown). The bottom wall 1A of the motor housing 1 has a shaft support portion 1G extending rearward in the axial direction and receiving therein a bearing 21.

The motor mechanism 3 includes a stator 15 and a rotor 17. The stator 15 is fixed to the inner peripheral surface of the cylindrical portion 1D of the motor housing 1. A lead wire 16C and a cluster block 16 are housed in the cylindrical portion 1D.

The cluster block 16 has connection terminals 16A and 16B. The connection terminal 16A extends out of the motor housing 1 through the bottom wall 1A. The connection terminal 16B is connected to the stator 15 through the lead wire 16C. Power is supplied appropriately from a power supply unit (not shown) to the stator 15 through the cluster block 16 and the lead wire 16C.

The rotor 17 is disposed radially inward of the stator 15. The aforementioned rotary shaft 19 has the axis of rotation X1 and extends in the longitudinal direction in the rotor 17. The front end portion of the rotary shaft 19 is supported by the bearing 21.

The main housing 9 is fixed to the rear end of the motor housing 1 by a plurality of bolts (not shown). The main housing 9 has an open end 9E at the front end thereof and a bottom wall 9D closing the rear end thereof. The open end 9E of the main housing 9 is abutted to the open end 1B of the motor housing 1 to thereby close the motor housing 1 and the main housing 9. A gasket 22 is provided between the open end 1B and the open end 9E of the main housing 9.

The main housing 9 has at the open end 9E thereof a first stepped portion 9F that is formed by recessing part of the inner peripheral surface of the main housing 9 annularly about the axis of rotation X1 of the rotary shaft 19. The motor housing 1 has at the open end 1B thereof a second stepped portion 1H that is formed by recessing part of the inner peripheral surface of the motor housing 1 annularly about the axis of rotation X1 of the rotary shaft 19. The first side plate 4 is fitted in the annular recess thus formed by the first stepped portion 9F and the second stepped portion 1H. The first side plate 4 is a planar member that extends radially in a plane perpendicular to the axis of rotation X1. The outer circumferential portion of the first side plate 4 is held by and between the second stepped portion 1H of the motor housing 1 and the first stepped portion 9F of the main housing 9.

An O-ring 23 is provided between the outer peripheral surface of the first side plate 4 and the inner peripheral surface of the first stepped portion 9F to seal therebetween. The first side plate 4 has therethrough a shaft hole 4A through which the rotary shaft 19 is passed. The shaft hole 4A is coated (not shown) so that the rotary shaft 19 slides and rotates smoothly in the shaft hole 4A. The first side plate 4 has on the rear side thereof an annular groove 4C that is formed annularly about the axis of rotation X1 of the rotary shaft 19.

A cover 35 is connected and fixed to the second side plate 5. The cylinder block 7, the second side plate 5, and the cover 35 are accommodated in the main housing 9. The cylinder block 7 and the second side plate 5 are connected to the rear of the first side plate 4 by bolts 25A to 25D shown in FIG. 3. The cylinder block 7 is held on the front and rear sides thereof by the first side plate 4 and the second side plate 5, respectively.

The second side plate 5 is fitted to the inner peripheral surface of the main housing 9. The second side plate 5 is a planar member that extends radially in a plane perpendicular to the axis of rotation X1 of the rotary shaft 19. An O-ring 24 is provided between the outer peripheral surface of the second side plate 5 and the inner peripheral surface of the main housing 9.

Figure 2:
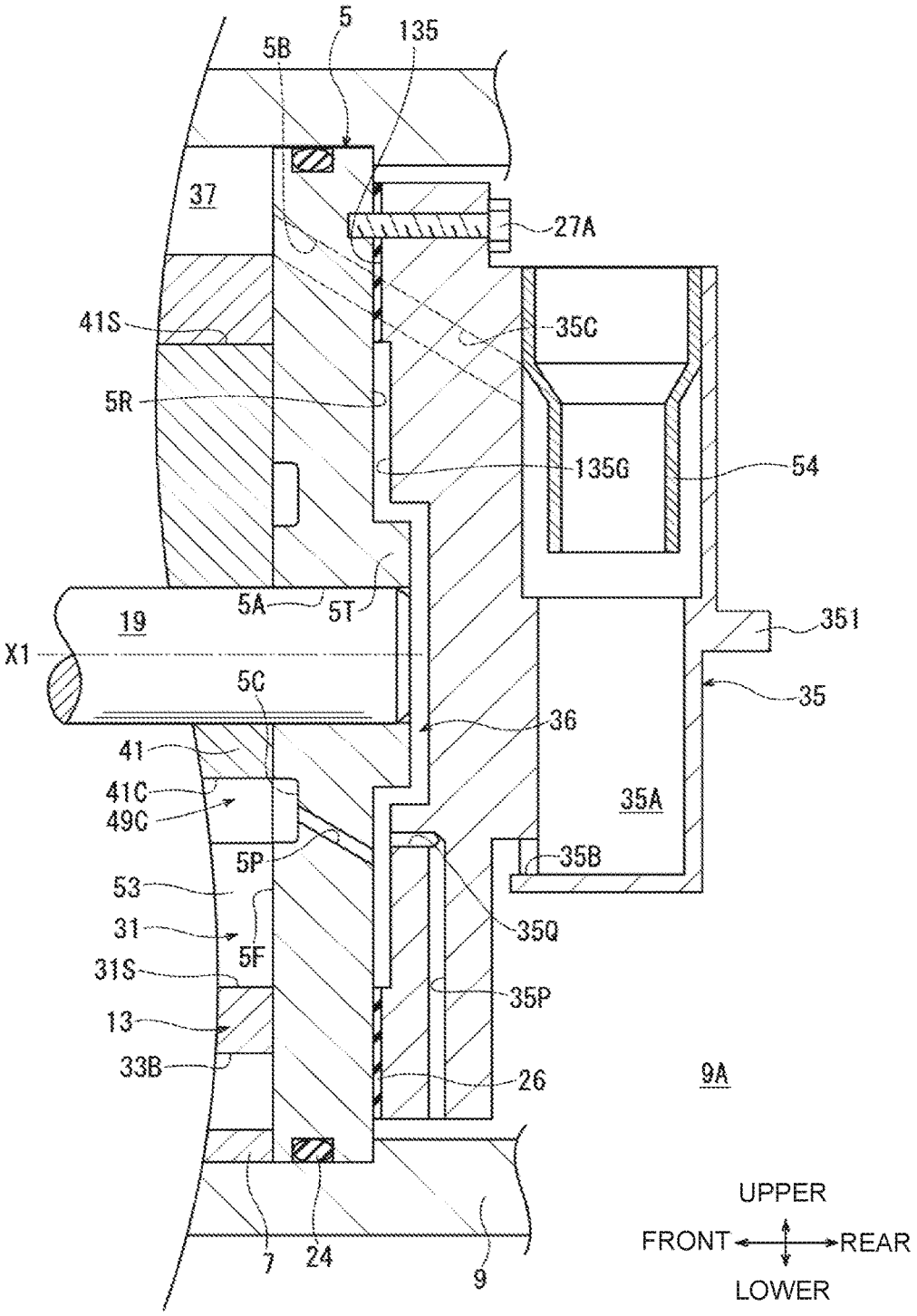
FIG. 2 is a partially enlarged longitudinal cross-sectional view of a part of the vane compressor of FIG. 1.
Figure 4:
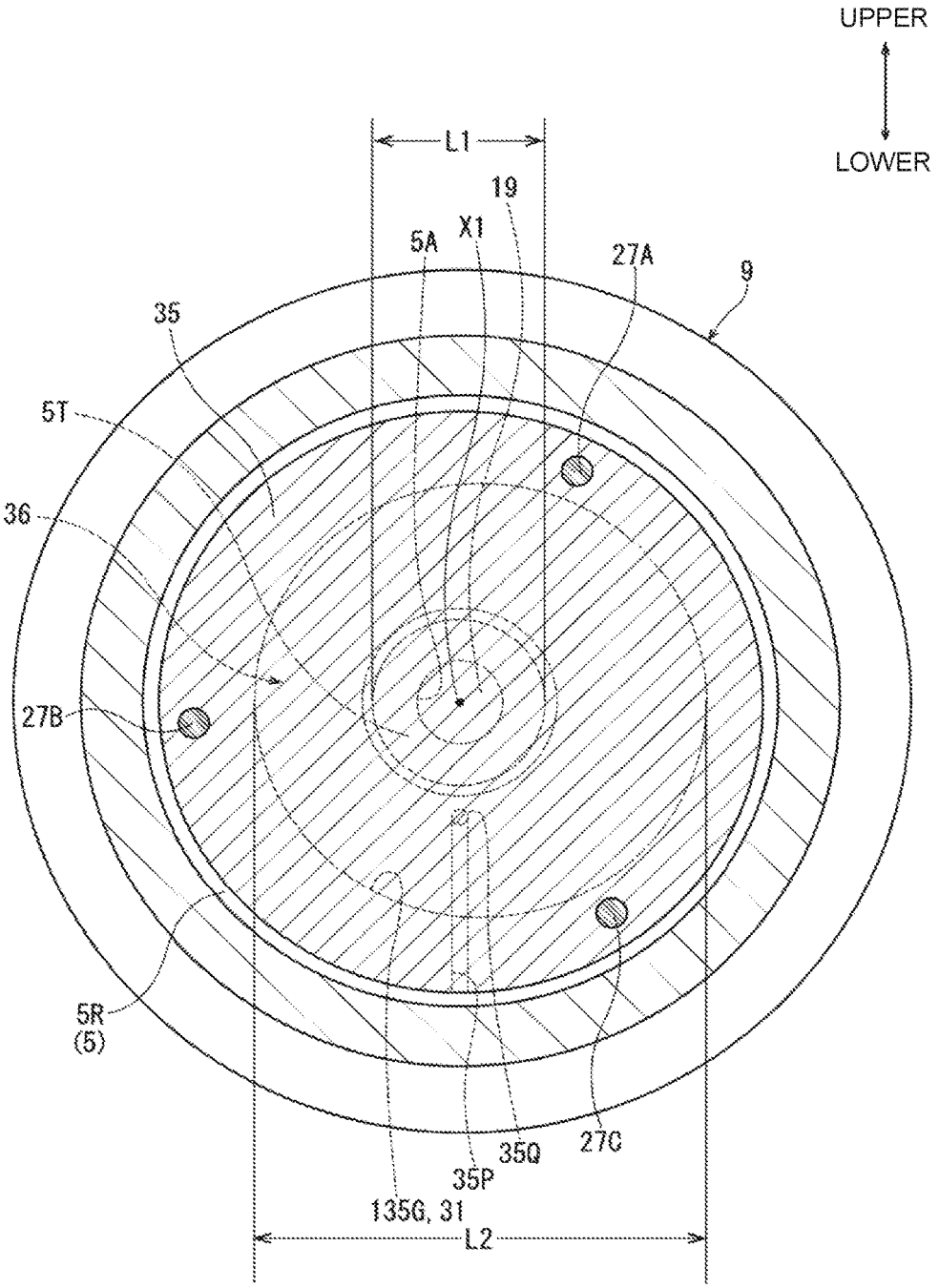
FIG. 4 is a transverse cross-sectional view of the vane compressor taken along line II-II of FIG. 1.

As shown in FIG. 2, the second side plate 5 has a first surface 5F and a second surface 5R. The first surface 5F faces frontward of the compressor. The second surface 5R is a surface that is opposite to the first surface 5F in the axial direction of the rotary shaft 19 and faces rearward of the compressor. The second surface 5R has a protruding portion 5T extending rearward, that is, toward the cover 35. As shown in FIG. 4, the protruding portion 5T has a cylindrical shape having a diameter L1. As shown in FIG. 2, the protruding portion 5T has therethrough a shaft hole 5A which is coaxial with the axis of rotation X1 and through which the rotary shaft 19 is passed. The shaft hole 5A is coated (not shown) so that the rotary shaft 19 slides and rotates smoothly in the shaft hole 5A.

The rotary shaft 19 is supported at the rear end portion thereof by the shaft hole 5A. Thus, the rotary shaft 19 is supported at opposite ends thereof by the shaft hole 4A of the first side plate 4 and the shaft hole 5A of the second side plate 5 so as to be rotatable about the axis of rotation X1.

A passage 5B is formed through the second side plate 5. The passage 5B is in communication with a discharge space 37, which will be described later. The first surface 5F has therein an annular groove 5C that is formed annularly about the axis of rotation X1 of the rotary shaft 19. A communication passage 5P is formed through the second side plate 5. The communication passage 5P extends from the second surface 5R and is opened to the annular groove 5C in the first surface 5F. The communication passage 5P and the annular groove 5C correspond to the backpressure passage of the present invention.

A discharge chamber 9A is formed between the bottom wall 9D of the main housing 9 and the second surface 5R of the second side plate 5. An outlet port 9B is formed through the main housing 9 to provide communication between the discharge chamber 9A and outside of the compressor. A condenser (not shown) of the vehicle air conditioner is connected to the outlet port 9B through a pipe (not shown).

The aforementioned cover 35 is a planar member extending radially in a plane perpendicular to the axis of rotation X1 of the rotary shaft 19 and connected to the second side plate 5. Specifically, as shown in FIG. 4, the cover 35 is connected to the second surface 5R of the second side plate 5 by bolts 27A to 27C. A gasket 26 is provided between the cover 35 and the second surface 5R. It is to be noted that, for the ease of explanation, an oil drain port 35B, which will be described later, is not illustrated in FIGS. 4 and 8. Furthermore, it is to be noted that the number of bolts 27A to 27C may be changed appropriately and an O-ring or the like may be used alternatively to the gasket 26.

The first side plate 4 and the second side plate 5 are made of an aluminum alloy having a strength enough to withstand sliding contact with the rotary shaft 19 and a rotor 41, which will be described later. The cover 35 is also made of an aluminum alloy. However, the cover 35 is made of an inexpensive aluminum alloy having a strength that is lower than the first and second side plates 4, 5.

As shown in FIG. 2, the cover 35 has a covering surface 135 that faces the second surface 5R of the second side plate 5 of the compressor. The covering surface 135 of the cover 35 has a recessed portion 135G that is recessed away from the second surface 5R and the protruding portion 5T. As shown in FIG. 4, the recessed portion 135G and a rotor chamber 31, which will be described in detail later, have a cylindrical shape and disposed eccentrically with respect to the axis of rotation X1. The recessed portion 135G and the rotor chamber 31 have the same diameter L2, which is greater than the diameter L1 of the protruding portion 5T.

As shown in FIG. 2, an intermediate pressure chamber 36 is formed by the recessed portion 135G of the cover 35 and the second side plate 5.

Specifically, the intermediate pressure chamber 36 is formed between the second surface 5R and the covering surface 135, and the recessed portion 135G is formed recessed away from the second surface 5R and the protruding portion 5T. In such an arrangement, a region of the second surface 5R which includes the protruding portion 5T and faces the recessed portion 135G, and a region of the cover 35 where the recessed surface of the recessed portion 135G is formed are spaced away from each other in the axial direction of the rotary shaft 19 by the intermediate pressure chamber 36. The intermediate pressure chamber 36 is formed so as to overlap the protruding portion 5T and hence the rotary shaft 19 and the shaft hole 5A. As shown in the cross-sectional view of FIG. 4, the intermediate pressure chamber 36 is formed larger than the protruding portion 5T. Additionally, the intermediate pressure chamber 36 is located eccentric with respect to the axis of rotation X1 and covers the whole of the protruding portion 5T as viewed in the direction of the axis of rotation X1. Furthermore, as shown in FIG. 2, the intermediate pressure chamber 36 and the annular groove 5C are in communication with each other through the communication passage 5P. The intermediate pressure chamber 36 is maintained hermetically by the aforementioned gasket 26.

An oil separation chamber 35A is formed in the cover 35 on the side thereof that is opposite to the covering surface 135, having a cylindrical shape and extending substantially perpendicular to the axis of rotation X1, A cylindrical member 54 is fixedly disposed within the oil separation chamber 35A. The upper end of the cylindrical member 54 is opened to the discharge chamber 9A. The aforementioned oil drain port 35B formed at the lower end of the oil separation chamber 35A. A passage 35C is formed through the cover 35. The passages 35C and 5B are connected in communication with each other to thereby provide communication between the oil separation chamber 35A and a discharge space 37, which will be described later. The oil separation chamber 35A and the cylindrical member 54 form the oil separator of the present invention.

The cover 35 has a rib 351 protruding rearward in the compression chamber. The lubricant oil stored in the discharge chamber 9A tends to be stirred by the lubricant oil discharged from the oil drain port 35B and mixed with the refrigerant gas. The refrigerant gas mixed with the lubricant oil impinges against the rib 351, and the lubricant oil is separated from the refrigerant gas.

The cover 35 has therein a first oil passage 35P and a second oil passage 35Q. The first and second oil passages 35P and 35Q correspond to the oil passage of the present invention. The first oil passage 35P is in communication with the discharge chamber 9A at the lower end thereof and extending upward toward the axis of rotation X1. Specifically, the first oil passage 35P is opened at the lower end thereof to a part of the discharge chamber 9A that is lower than the oil drain port 35B in the vertical direction. One end of the second oil passage 35Q is connected with the upper end of the first oil passage 35P and the other end of the second oil passage 35Q is opened to the intermediate pressure chamber 36. Therefore, the discharge chamber 9A and the intermediate pressure chamber 36 are in communication with each other through the first and second oil passages 35P and 35Q. The lubricant oil that is separated from the refrigerant gas by the oil separation chamber 35A and the cylindrical member 54 and stored in the discharge chamber 9A flows therefrom to the intermediate pressure chamber 36 through the first and second oil passages 35P and 35Q. The first and second oil passages 35P and 35Q serves as a restriction passage. Specifically, the first and second oil passages 35P and 35Q guide lubricant oil to the intermediate pressure chamber 36 so that the pressure in the intermediate pressure chamber 36 is lower than the pressure in the discharge chamber 9A but higher than the pressure in the motor chamber 1C.

Figure 3:
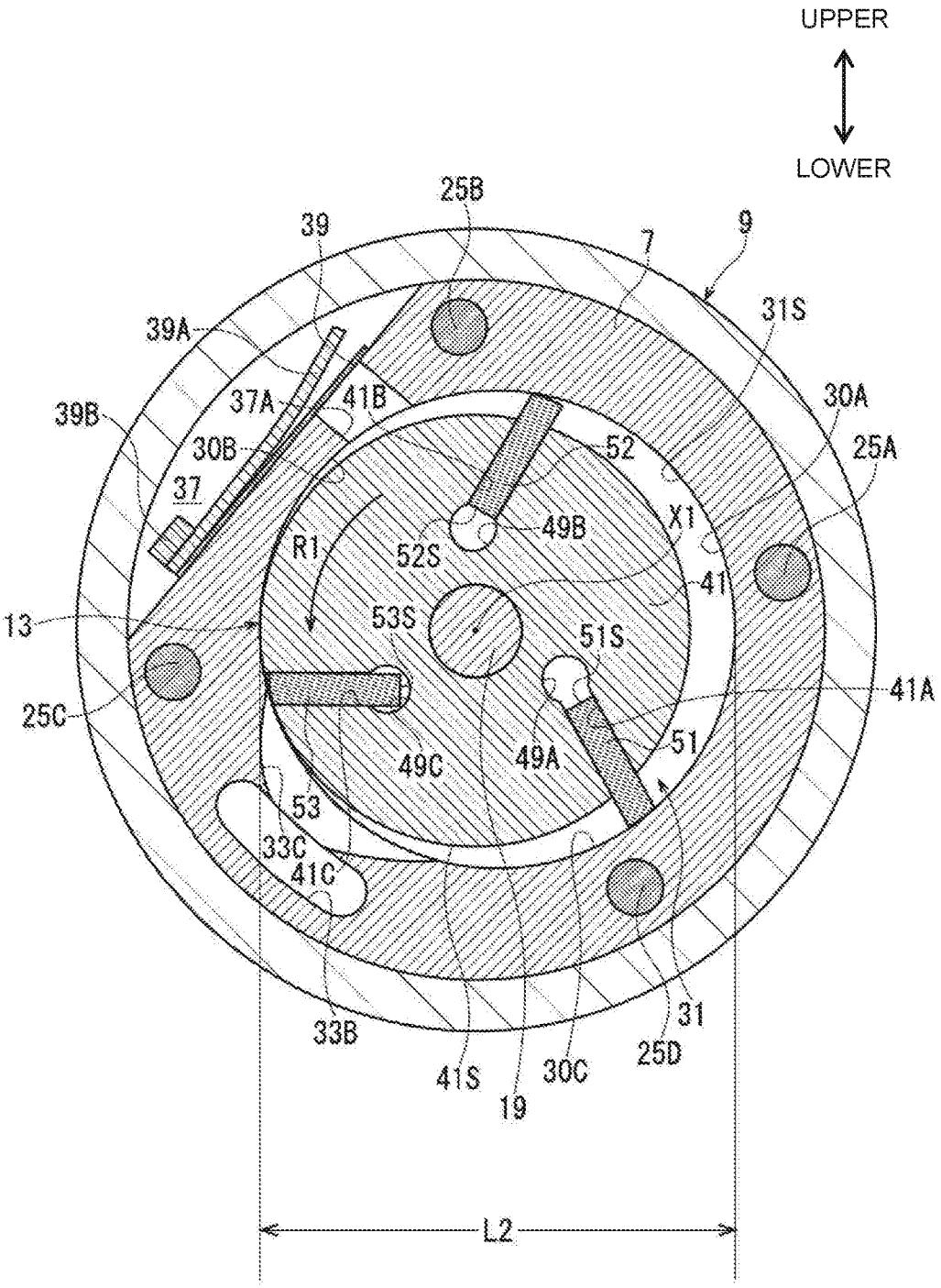
FIG. 3 is a transverse cross-sectional view of the vane compressor taken along line I-I of FIG. 1.

As shown in FIG. 1, the cylinder block 7 has a cylindrical shape and disposed extending in the direction in which the axis of rotation X1 of the rotary shaft 19 extends. The cylinder block 7, the first side plate 4, and the second side plate 5 form the rotor chamber 31 in the cylinder block 7. As shown in FIG. 3, an inner peripheral surface 31S of the rotor chamber 31, or the inner peripheral surface of the cylinder block 7, forms substantially a true circle in cross section that is eccentric to the axis of rotation X1 and has the diameter L2 as described earlier. The front surface of the rotor chamber 31, which is formed in the rear surface of the first side plate 4, corresponds to the one surface of the rotor chamber of the present invention and a rear surface of the rotor chamber 31 corresponds to the other surface of the rotor chamber of the present invention. Furthermore, as shown in FIG. 1, the rear surface of the rotor chamber 31 is formed by the first surface 5F of the second side plate 5. It is to be noted that the rotor chamber 31 may not be a true circle in cross section as long as first to third vanes 51 to 53, which will be described later, are movable in sliding contact with the inner peripheral surface 31S.

As shown in FIG. 1, the first side plate 4 has therethrough a suction passage 33A extending in the axial direction of the rotary shaft 19 and opened at one end thereof to the motor chamber 1C. The cylinder block 7 has therethrough a suction passage 33B that is formed in communication with the suction passage 33A. As shown in FIG. 3, the suction passage 33B is communicable with the rotor chamber 31 through a suction port 33C formed in the cylinder block 7.

The aforementioned discharge space 37 is formed between part of the outer periphery of the cylinder block 7 and the inner periphery of the main housing 9. The discharge space 37 is communicable with the rotor chamber 31 through a discharge port 37A formed through the peripheral wall of the cylinder block 7. In the discharge space 37, a discharge reed valve 39 for opening and closing the discharge port 37A and a retainer 39A that regulates the opening of the discharge reed valve 39 are fixed to the cylinder block 7 by a bolt 39B.

The rotor chamber 31, the rotor 41, and the first to third vanes 51 to 53 form the compression mechanism 13.

As shown in FIG. 1, the rotary shaft 19 is press-fitted to be fixed in the rotor for rotation therewith in the rotor chamber 31. As shown in FIG. 3, an outer peripheral surface 41S of the rotor 41 forms substantially a true circle in cross section that has the axis of rotation X1 at the center thereof. According to the first embodiment, the rotor 41 rotates counterclockwise as indicated by arrow R1 as viewed in FIG. 3.

Figure 5:
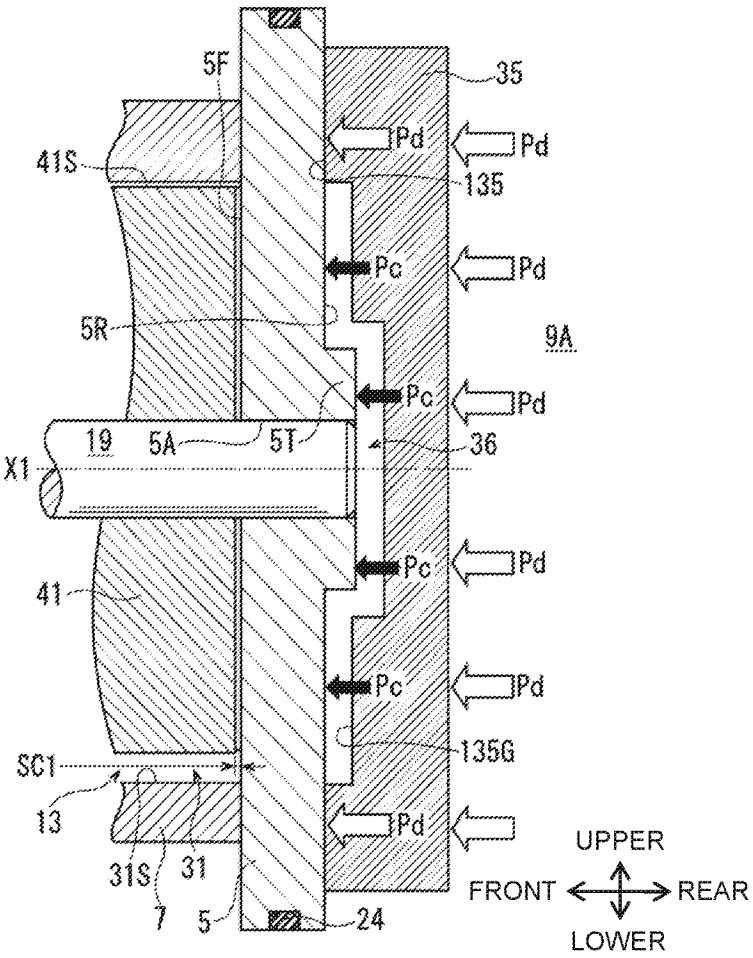
FIG. 5 is a schematic view explaining the discharge pressure applied to the cover and the second surface of a rear side plate and the intermediate pressure applied to the second surface of the rear side plate in the vane compressor according to the first embodiment.

As shown in FIG. 5, a thrust clearance SC1 of a predetermined dimension is provided between the rear end surface of the rotor 41 and the first surface 5F of the second side plate 5. Although not shown in the drawing, the thrust clearance SC1 is also provided between the front end surface of the rotor 41 and the rear surface of the first side plate 4. It is to be noted that in FIGS. 5 and 6, the second side plate 5, the cover 35 and the peripheries thereof are illustrated schematically for the ease of explanation. Furthermore, the gasket 26 is not illustrated in FIGS. 5 and 6.

As shown in FIG. 3, the rotor 41 has therein first to third vane slots 41A, 41B, and 41C that are disposed equidistantly and extend generally radially toward the axis of rotation X1 of the rotor 41 from the periphery of the rotor 41.

A first vane Si is inserted in the first vane slot 41A so as to be slidable in and out of the first vane slot 41A. With the rotation of the rotor 41, the first vane 51 slides in and out of the first vane slot 41A with the tip of the first vane 51 kept in sliding contact with the inner peripheral surface 31S of the rotor chamber 31. Similarly, a second vane 52 is inserted in the second vane slot 41B so as to be slidable in and out of the second vane slot 41B and a third vane 53 is inserted in the third vane slot 41C so as to be slidable in and out of the third vane slot 41C. The first to third vanes 51 to 53 are flat plates of the same shape. The front and rear surfaces and the inner peripheral surface 31S of the rotor chamber 31, and the first to third vanes 51 to 53 are coated (not shown) for smooth relative sliding movement to the rotor 41.

Compression chambers 30A, 30B, and 30C are formed by the front surface of the rotor chamber 31, the inner peripheral surface 31S of the rotor chamber 31, the first surface 5F of the second side plate 5, the outer peripheral surface 41S of the rotor 41, and the first to third vanes 51 to 53. As described above, the rear surface of the rotor chamber 31 is formed by the first surface 5F of the second side plate 5, so that the rotor chamber 31 and the discharge chamber 9A are separated from each other by the second side plate 5.

As described above, as with the rotor chamber 31, the recessed portion 135G formed in the covering surface 135 is eccentric to the axis of rotation X1 of the rotary shaft 19 and has the same diameter as the rotor chamber 31. Therefore, as shown in FIG. 4, the intermediate pressure chamber 36 is formed between the second surface 5R and the covering surface 135 so as to overlap the whole protruding portion 5T and the whole of the rear surface of the rotor chamber 31 as viewed in the direction of the axis of rotation X1.

As described above, the intermediate pressure chamber 36 is formed so as to space the region of the second surface 5R of the second side plate 5 which includes the protruding portion 5T and faces the recessed portion 135G of the cover 35 and the region where the recessed surface of the recessed portion 135G is formed away from each other in the axial direction of the rotary shaft 19. The intermediate pressure chamber 36 has a volume enough to produce a pressing force opposing the discharge pressure. If the volume of the intermediate pressure chamber 36 is too large, it will take a longer time for the lubricant oil to pass through the intermediate pressure chamber 36, resulting in a delay in the supply of backpressure to first to third backpressure chambers 49A to 49C, which will be described later, at a start of compressor operation and hence in an occurrence of chattering of the vanes 51 to 53. Therefore, the volume of the intermediate pressure chamber 36 is determined within a specified range that prevents occurrence of chattering. The pressing force of the intermediate pressure chamber 36 that opposes the discharge pressure will be described later in detail.

As shown in FIG. 3, the aforementioned first backpressure chamber 49A is formed between a bottom surface 51S of the first vane 51 and the first vane slot 41A. Similarly, the second backpressure chamber 49B is formed between a bottom surface 52S of the second vane 52 and the second vane slot 41B. The third backpressure chamber 49C is formed between a bottom surface 53S of the third vane 53 and the third vane slot 41C. The first to third backpressure chambers 49A to 49C are in communication with the annular groove 5C (FIG. 1) and the intermediate pressure chamber 36 through the communication passage 5P.

As the motor mechanism 3 is started to cause the rotary shaft 19 to rotate about the axis of rotation X1, the compression mechanism 13 is operated and the rotor 41 rotates in the cylinder block 7. With the rotation of the rotor 41, the first to third vanes 51 to 53 slide in and out of the first to third vane slots 41A to 410, respectively.

With such movement, the volume of the respective compression chambers 30A to 30C increases and decreases repeatedly alternately. In a suction phase, refrigerant gas at a low pressure is taken in from the motor chamber 10 through the suction passages 33A and 33B and the suction port 33C for compression in the compression chambers 30A to 30C. The refrigerant gas compressed to a high pressure in the compression chambers 30A to 30C in a compression phase is discharged into the discharge chamber 9A through the discharge port 37A, the discharge space 37, the passage 5B, and the passage 35C in a discharge phase. With such operation air conditioning is performed in a vehicle.

The refrigerant gas compressed to a high pressure is discharged through the passages 5B and 35C to the oil separation chamber 35A, where lubricant oil contained in the compressed refrigerant gas is separated therefrom by centrifugal force. The lubricant oil thus separated from the refrigerant gas is stored in the discharge chamber 9A. Part of the lubricant oil in the discharge chamber 9A of a high pressure is supplied to the intermediate pressure chamber 36 through the first and second oil passages 35P and 350. The lubricant oil in the intermediate pressure chamber 36 is supplied further to the first to third backpressure chambers 49A to 49C through the communication passage 5P and the annular groove 5C. During the time, the pressures in the respective first to third backpressure chambers 49A to 49C are adjusted by the annular groove 4C.

The first and second oil passages 35P and 350 are formed not in the second side plate 5 but in the cover 35, the second side plate 5 does not need to have a thickness, or a dimension in the axial direction of the rotary shaft 19, that is large enough to form therein the first and second oil passages 35P and 35Q The thickness of the second side plate 5 may be rather reduced accordingly. Since the cover 35 is disposed in the discharge chamber 9A, formation of the first and second oil passages 35P and 350 in the cover 35 will not affect or increase the size of the compressor in the axial direction of the rotary shaft 19. Therefore, the compressor of the first embodiment achieves reduction of the size in the axial direction of the rotary shaft 19.

The compressor according to the first embodiment is capable of suppressing a drop in the volumetric efficiency. This effect will now be described more in detail through comparison with a compressor of a comparative example shown in FIG. 6.

The second side plate 5 of the compressor according to the comparative example has the same dimension in the axial direction of the rotary shaft 19 as the second side plate 5 according to the first embodiment. However, the covering surface 135 of the cover 35 according to the comparative example has no recessed portion such as 135G, and, therefore, no intermediate pressure chamber such as 36 is provided between the second side plate 5 and the cover 35 and the entire covering surface 135 is set in contact with the second surface 5R of the second side plate 5. Other configurations of the compressor than the above are common in the first embodiment and the comparative example.

Figure 6:
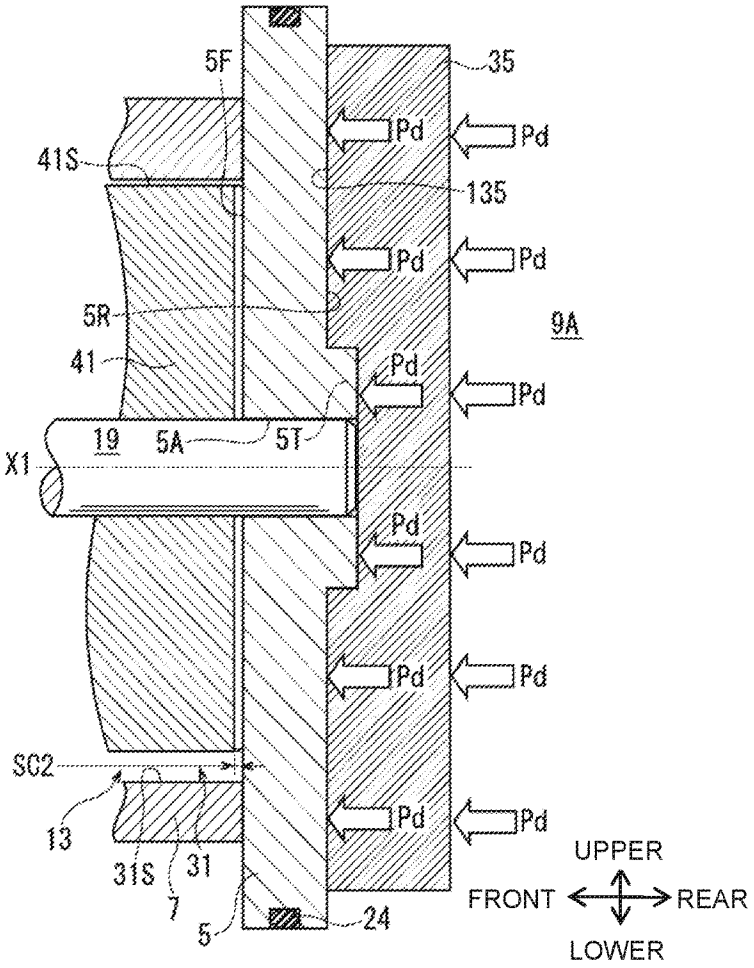
FIG. 6 is a schematic view explaining the discharge pressure applied to the cover and the second surface of the rear side plate in a vane compressor according to a comparative example.

Referring to FIG. 6 showing the compressor of the comparative example, the discharge pressure Pd in the discharge chamber 9A during the operation of the compressor is applied to the whole of the second surface 5R of the second side plate 5 through the cover 35 in the direction indicated by blank arrows, so that the second surface 5R is pressed toward the compression chambers 30A to 30C, which may cause the second side plate 5 to bend toward the rotor chamber 31, that is, toward the compression chambers 30A to 30C. Therefore, in the compressor of the comparative example, a thrust clearance SC2 provided between the rear end surface of the rotor 41 and the first surface 5F of the second side plate 5 may be reduced excessively compared to a predetermined value during the operation of the compressor, resulting in an increase of the resistance when the rotor 41 is rotated under a high load and hence in a significant power loss.

In order to prevent such problems, it may be contemplated to increase the thrust clearance SC2 to be greater than the thrust clearance SC1 (FIG. 5). However, if the thrust clearance SC2 is increased, refrigerant gas in the compression chambers 30A to 30C may leak therefrom easily during the compressor operation under a low load, with the result that the volumetric efficiency of the compressor tends to drop.

Contrary to this, the compressor according to the first embodiment has the recessed portion 135G in the covering surface 135 and the intermediate pressure chamber 36 is formed between the second surface 5R and the covering surface 135. The intermediate pressure chamber 36 is provided to space away the region of the second surface 5R of the second side plate 5 which includes the outer surface of the protruding portion 5T and faces the recessed portion 135G, and the region of the cover 35 where the recessed surface of the recessed portion 135G is formed from each other in the axial direction of the rotary shaft 19. Furthermore, as shown in FIG. 4, the intermediate pressure chamber 36 is formed between the second surface 5R and the covering surface 135 so as to overlap the whole protruding portion 5T and the whole of the rear surface of the rotor chamber 31 as viewed in the direction of the axis of rotation X1. Lubricant oil is supplied from the discharge chamber 9A to the intermediate pressure chamber 36 through the first and second oil passages 35P and 35Q. In this case, the first and second oil passages 35P and 35Q guide the lubricant oil to the intermediate pressure chamber 36 so that the pressure in the intermediate pressure chamber 36 is lower than the pressure in the discharge chamber 9A but higher than the pressure in the motor chamber 1C. Therefore, the pressure Pc in the intermediate pressure chamber 36, which is indicated by solid black arrows in FIG. 5, is lower than the pressure in the discharge chamber 9A but higher than the pressure in the motor chamber 1C.

In the compressor of the first embodiment, the discharge pressure Pd, which is indicated by blank arrows in FIG. 5 and applied to the cover 35, is blocked in the region of the second surface 5R which faces the intermediate pressure chamber 36 and includes the protruding portion 5T, by the intermediate pressure chamber 36. The intermediate pressure Pc in the intermediate pressure chamber 36 is applied to the region, as indicated by the solid black arrows. The discharge pressure Pd is applied to the remained region of the second surface 5R located radially outward of the intermediate pressure chamber 36 through the cover 35.

The intermediate pressure chamber 36 is formed so as to overlap the whole protruding portion 5T as viewed in the direction of the axis of rotation X1, so that the region of the second surface 5R where the intermediate pressure Pc is applied is large. Therefore, in the compressor of the first embodiment, the pressure that pushes the second surface 5R toward the compression chambers 30A to 30C during the operation is smaller as compared with the compressor of the comparative example in which the discharge pressure Pd is applied to the whole of the second surface 5R. Therefore, the second side plate 5 with a reduced thickness may hardly bend toward the compression chambers 30A to 30C. Particularly, the second side plate 5 may retain its strength since the second side plate 5 has therein no oil passages such as 35P and 35Q which may reduce the strength of the second side plate 5.

In the compressor of the first embodiment, the thrust clearance SC1 is not reduced easily compared to a predetermined set value during the operation of the vane compressor. As a result, the resistance when the rotor 41 is rotated during the compressor operation under a high load is prevented from being increased and, accordingly, a significant increase of the power loss is prevented. There is no need of increasing the thrust clearance SC1 in the compressor of the first embodiment and, therefore, the tendency of leaking of refrigerant gas from the compression chambers 30A to 30C under a low load is prevented.

Therefore, in the compressor of the first embodiment, the dimension in the direction of the axis of rotation X1 of the rotary shaft 19 may be reduced and the drop in the volumetric efficiency is prevented.

The use of the second side plate 5 having its thickness thus reduced while preventing its deflection due to discharge pressure eliminates the need for using a material of high rigidity for the second plate 5, which contributes to reduction of the cost for manufacturing the second side plate 5 and hence to the cost reduction of the compressor itself.

In the compressor of the first embodiment, wherein the second side plate 5 has the protruding portion 5T projecting toward the cover 35 and the shaft hole 5A is formed through the second side plate 5, the length of the shaft hole 5A is extended by the protruding portion 5T, providing a satisfactory support of the rotary shaft 19. Because the intermediate pressure chamber 36 is formed so as to overlap the whole of the rear surface of the protruding portion 5T, the intermediate pressure chamber 36 also overlaps the rotary shaft 19 and the shaft hole 5A. With this configuration, lubricant oil guided to the intermediate pressure chamber 36 is supplied stably to the rotary shaft 19 and the shaft hole 5A to lubricate the rotary shaft 19 and the shaft hole 5A.

The cover 35 has therein the oil separation chamber 35A. With this configuration, the cover 35 also serves to separate lubricant oil from the refrigerant gas and, therefore, the number of parts may be reduced as compared with a compressor in which the oil separation chamber and the cover are formed separately.

In the configuration in which the first oil passage 35P is opened at the lower end thereof to the discharge chamber 9A at a position that is lower than the oil drain port 35B in the vertical direction, lubricant oil stored in the discharge chamber 9A is supplied therefrom to the intermediate pressure chamber 36 securely through the first and second oil passages 35P and 35Q without shortage.

In the compressor of the first embodiment, lubricant oil in the intermediate pressure chamber 36 is supplied to the first to third backpressure chambers 49A to 49C through the communication passage 5P and the annular groove 5C, so that the first to third vanes 51 to 53 are pressed appropriately against the inner peripheral surface 31S of the rotor chamber 31 by the lubricant oil in the first to third backpressure chambers 49A to 49C. Therefore, development of chattering of the vanes 51 to 53 is suppressed and a drop in the volumetric efficiency is suppressed.

Second Embodiment

Figure 7:
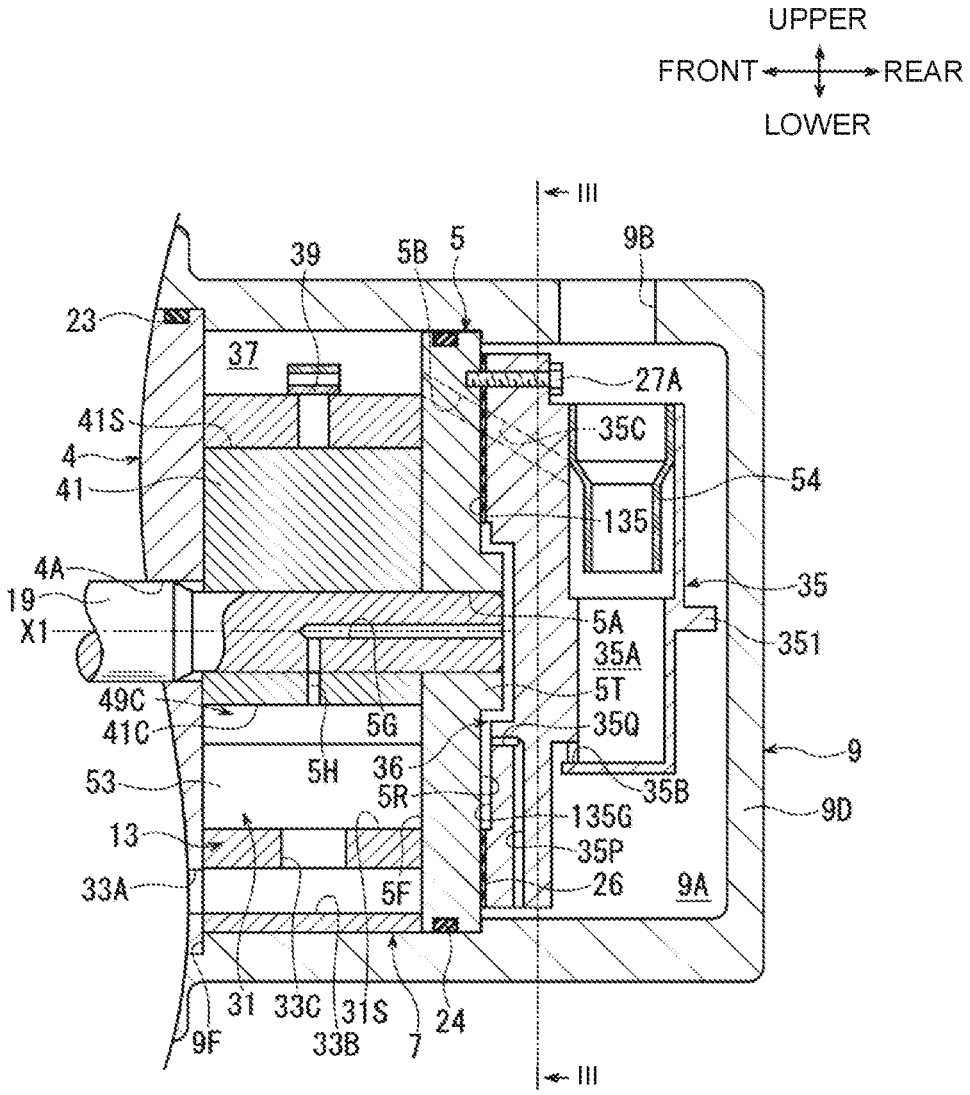
FIG. 7 is a fragmentary longitudinal cross-sectional view of a vane compressor according to a second embodiment of the present invention.

FIG. 7 shows a motor-driven vane compressor according to a second embodiment of the present invention. The compressor according to the second embodiment differs from the compressor according to the first embodiment in that the second side plate 5 does not have the annular groove 5C and the communication passage 5P. In the compressor according to the second embodiment, the rotary shaft 19 has therein an axial passage 5G and a first radial passage 5H that is formed extending radially in the rotary shaft 19 and the rotor 41. The axial passage 5G extends forward from the rear end surface of the rotary shaft 19 in the direction of the axis of rotation X1 thereof. The first radial passage 5H extends radially in the rotary shaft 19 and the rotor 41 from the front end of the axial passage 5G and is in communication with the third backpressure chamber 49C, so that the intermediate pressure chamber 36 and the third backpressure chamber 49C are in communication with each other through the axial passage 5G and the first radial passage 5H. Although not shown in the drawing, a second radial passage that extends radially and provides communication between the axial passage 5G and the first backpressure chamber 49A and a third radial passage that extends radially and provides communication between the axial passage 5G and the second backpressure chamber 49B are formed in the rotary shaft 19 and the rotor 41. The axial passage 5G, the first radial passage 5H, the second radial passage, and the third radial passage correspond to the backpressure passage of the present invention.

Figure 8:
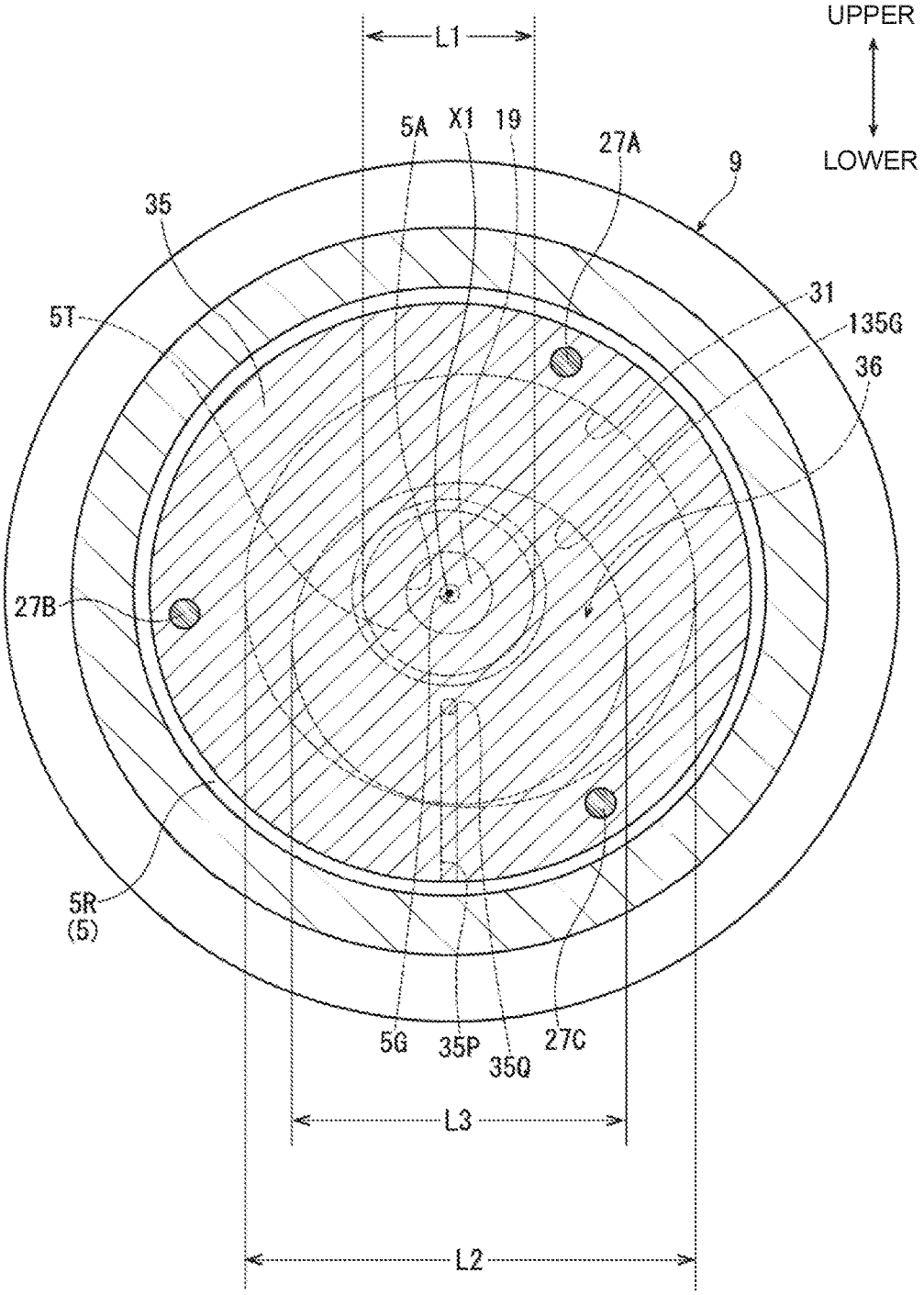
FIG. 8 is a transverse cross-sectional view of the vane compressor taken along line of FIG. 7.

Furthermore, the recessed portion 135G of the compressor according to the second embodiment is formed smaller in diameter than the counterpart recessed portion 135G of the first embodiment. Specifically, as shown in FIG. 8, the recessed portion 135G has a diameter L3 that is greater than the diameter L1 of the protruding portion 5T but smaller than the diameter L2 of the rotor chamber 31. Accordingly, in the compressor of the second embodiment, the diameter of the recessed portion 135G and hence the diameter of the intermediate pressure chamber 36 are greater than the diameter of the protruding portion 5T but smaller than the diameter of the rotor chamber 31. Therefore, the intermediate pressure chamber 36 is disposed between the second surface 5R and the covering surface 135 so as to overlap the whole of the protruding portion 5T and a part of the rear surface of the rotor chamber 31, as viewed in the direction of the axis of rotation X1 in FIG. 8. The rest of the structure of the compressor according to the second embodiment is substantially the same as that of the first embodiment and, therefore, the same reference numerals are used for the same components and detailed description thereof will not be reiterated.

In the compressor according to the second embodiment, lubricant oil in the intermediate pressure chamber 36 is supplied to the third backpressure chamber 49C through the axial passage 5G and the first radial passage 5H. Similarly, the lubricant oil in the intermediate pressure chamber 36 is supplied to the first backpressure chamber 49A through the axial passage 5G and the second radial passage and also supplied to the second backpressure chamber 49B through the axial passage 5G and the third radial passage. Other effects of the compressor of the second embodiment are the same as those of the compressor of the first embodiment.

Although the first and second embodiments of the present invention have been described, the present invention is not limited to the above two embodiments, and it may variously be modified within the spirit of the present invention.

For example, the first side plate 4 may be formed with a cylindrical portion that extends axially therefrom toward the second side plate 5 and forms the inner peripheral surface of the rotor chamber 31. Alternatively, the second side plate 5 may be formed with a similar cylindrical portion that extends axially therefrom toward the first side plate 4 and forms the inner peripheral surface of the rotor chamber 31.

It may be configured such that the first side plate 4 and the second side plate 5 are formed with cylindrical portions extending axially toward each other to form the inner peripheral surface of the rotor chamber 31, respectively.

The shape of the intermediate pressure chamber 36 may be modified, for example, by increasing the diameter to be greater than the diameter of the rear surface of the rotor chamber 31.

A plurality of intermediate pressure chambers such as 36 may be formed between the second side plate 5 and the cover 35.

In the compressor according to the first and second embodiments, three vanes, namely the first to third vanes 51 to 53, are provided. According to the present invention, however, the number of the vanes is not limited to three, and may be changed to two or four, for example.

The present invention is applicable to an air conditioner for a vehicle or the like.

What is claimed is:

1. A vane compressor comprising:

a housing having therein a suction chamber, a discharge chamber, and a rotor chamber;

a rotor that is disposed in the rotor chamber so as to be rotatable about an axis of rotation and has therein a plurality of vane slots;

a plurality of vanes that is provided in the respective plurality of vane slots so as to be slidable in and out of the plurality of vane slots; and a plurality of compression chambers formed by one surface of the rotor chamber, an inner peripheral surface of the rotor chamber, an other surface of the rotor chamber, an outer peripheral surface of the rotor, and the plurality of vanes, wherein the housing includes a partition that separates the rotor chamber from the discharge chamber, the partition has a first surface forming the other surface of the rotor chamber and a second surface that is located opposite to the first surface in the direction of the axis of rotation, the discharge chamber has therein a cover that is fixed to the partition and has a covering surface facing the second surface, an intermediate pressure chamber is formed between the partition and the cover, the intermediate pressure chamber spacing a part of the second surface and a part of the covering surface away from each other in the direction of the axis of rotation, the intermediate pressure chamber having a pressure that is lower than a pressure in the discharge chamber and higher than a pressure in the suction chamber, the intermediate pressure chamber is disposed so as to overlap an entirety of the other surface of the rotor chamber as viewed in the direction of the axis of rotation, and an oil passage is formed in the cover and provides communication between the discharge chamber and the intermediate pressure chamber.

2. The vane compressor according to claim 1, wherein the cover includes at least a part of an oil separator that separates lubricant oil from refrigerant gas.

3. The vane compressor according to claim 2, wherein the oil separator has an oil drain port that provides communication with the discharge chamber, and the oil passage is opened to the discharge chamber at a position that is lower than the oil drain port in a vertical direction.

4. The vane compressor according to claim 1, wherein the rotor is fixed on a rotary shaft that extends in the direction of the axis of rotation, backpressure chambers are formed between the respective plurality of vane slots and the respective plurality of vanes, and the intermediate pressure chamber and the backpressure chambers are in communication with each other through at least a backpressure passage.

* * * * *